US005215143A

United States Patent [19]

Gentry

[11] Patent Number: 5,215,143

[45] Date of Patent: Jun. 1, 1993

[54] NON-POROUS CARBON MOLDING (FOUNDRY) SAND AND METHOD OF CASTING

[75] Inventor: Everett G. Gentry, Palm Springs, Calif.

[73] Assignee: American Colloid Company, Arlington Heights, Ill.

[21] Appl. No.: 977,282

[22] Filed: Nov. 16, 1992

[51] Int. Cl.[5] ..... B22C 1/00; B22C 3/00; B22C 9/00

[52] U.S. Cl. ..... 164/529; 106/38.22; 106/38.28; 106/38.9; 164/33; 427/134

[58] Field of Search ..... 164/529, 33; 106/38.22, 106/38.28, 38.9; 427/134

[56] References Cited

U.S. PATENT DOCUMENTS

| | | | |
|---|---|---|---|
| 2,830,342 | 4/1958 | Meyers et al. | 106/38.9 X |
| 2,830,913 | 4/1958 | Meyers et al. | 164/529 X |
| 3,802,902 | 4/1974 | Turner, Jr. et al. | 106/38.22 X |
| 5,094,289 | 3/1992 | Gentry | 164/529 |

FOREIGN PATENT DOCUMENTS

| | | | |
|---|---|---|---|
| 0111616 | 6/1984 | European Pat. Off. | 164/529 |
| 1-233041 | 9/1989 | Japan | 164/529 |

*Primary Examiner*—J. Reed Batten, Jr.

*Attorney, Agent, or Firm*—Marshall, O'Toole, Gerstein, Murray & Borun

[57] ABSTRACT

A new and improved, non-porous carbon foundry sand and a method of treating a fluid coke, having a spherical or ovoid particle shape and a size suitable for a coating surface, or a core or mold surface in the foundry industry, wherein the carbon sand is processed by heating the carbon particles at a controlled rate to a temperature in the range of about 1900° F. to about 2300° F. during a period of time preferably of more than about 30 minutes, and preferably for a period of about 1 to 2 hours, particularly to about 2000° F. to about 2200° F., and a method of casting molten metal against the heat treated carbon particles wherein the non-porous carbon foundry sand is combined with a suitable binder with which mixture a mold is formed to cast metal parts. The non-porous carbon sand also is useful in forming molds, cores, shell molds and shell cores and otherwise in using the carbon sand to replace other molding an core-making sands used in the foundry industry.

24 Claims, No Drawings

NON-POROUS CARBON MOLDING (FOUNDRY) SAND AND METHOD OF CASTING

FIELD OF THE INVENTION

The present invention is directed to a new and improved, non-porous carbon foundry sand to replace sand in molds and cores, either partially or entirely, in the metal casting industry. More particularly, the present invention is directed to a carbon-based molding sand for use in casting or molding ferrous and non. ferrous metal objects that is formed by heating spherical and/or ovoid carbon or coke particles at a controlled rate to a temperature in the range of about 1900° F. to about 2300° F., during a period preferably greater than 30 minutes, preferably at a rate of about 25° F. to 50° F./minute, to remove volatile compounds, and unexpectedly to render the carbon or coke particles non-porous thereby improving the carbon sand for use in forming green, dried and/or baked molds, green and baked cores, mold facings, shell molds and cores, gas. cured, heat-cured and chemically-cured cores and molds, and the like. The resulting non-porous carbon sand is particularly useful for casting ferrous metals, as well as non-ferrous metals, such as aluminum and copper metals, and alloys such as bronze, brass and the like. The resulting carbon sand will not absorb any appreciable amount (less than about 0.5% by weight) of water or liquid binders used in foundry sand practice.

BACKGROUND OF THE INVENTION AND PRIOR ART

Regular foundry sands are minerals dug from the ground or crushed from rock. Typical examples include silica sand, olivine sand, zircon sand and chromite sand. Silica sand accounts for approximately 90% of the sands used in the foundry industry. The other three sands are more thermally stable, but more expensive—zircon being the most thermally stable and most expensive. Neither of these sands is porous and neither contains any volatile matter.

Sand molds shape the outside of castings. Cores are sand shapes which are positioned inside the mold to shape the inside of a casting. If a core were not used, the casting would be solid metal and many castings are not solid, but have inside channels or configurations.

Molds are one of two kinds:

(1) "green" sand molds are bentonite (clay)/water bonded sand mixtures rammed against a pattern to form a desired contour (a top half or cope and a bottom half or drag are booked together to form a complete mold cavity). The sand is a tough, pliable mixture which will hold its molded shape. Molten metal is poured into the mold cavity where it solidifies to form the resultant casting.

(2) "rigid" molds are sand mixtures which can be molded against a pattern and then hardened into a rigid condition. The method of hardening depends on the kind of binder used. Although bentonite bonded molds can be hardened by air-drying or baking, usually rigid molds are bonded with organic resins which harden into much stronger and harder shapes. Binders are designed to be hardened by several methods. Some are baked; some are cured or hardened by chemical reaction with a reagent; and some are hardened by flushing with a reactive gas.

Cores are usually rigid shapes employing the same kinds of binders and methods described above for rigid molds.

Much as pavement buckles on a hot day, a sand mold or core can buckle due to expansion during the casting operation. The high temperature expansion buckle of the mold wall causes a defect on the casting surface known as a "buckle" or a "scab". If a core expands too much, the core will crack or craze and metal will enter the crack to form an irregular fin of metal on the cored surface of the casting which must be removed. Obviously, less thermal expansion in a sand is a great advantage. U.S. Pat. Nos. 2,830,342 and 2,830,913, are directed to the excellent thermal stability of carbon sands.

Relatively inexpensive silica sand grains bound together with a suitable binder are used extensively as a mold and core material for receiving molten metal in the casting of metal parts. Olivine sand is much more expensive than silica sand but, having better thermal stability than silica sand, provides cast metal parts of higher quality, particularly having a more defect-free surface finish, requiring less manpower after casting to provide a consumer-acceptable surface finish. Olivine sand, therefore, has been used extensively as a mold and core surface in casting non-ferrous parts in particular and has replaced silica sand in many of the non-ferrous foundries in the United States.

Spherical or ovoid grain, carbon or coke particles, known to the trade as petroleum fluid coke, also have been used as foundry sands where silica sands and olivine sands do not have the physical properties entirely satisfactory for casting metals such as aluminum, copper, bronze, brass, iron and other metals and alloys. Such a fluid coke carbon sand presently is being sold by American Colloid Company of Arlington Heights, Ill. under the trademark CAST-RITE® and has been demonstrated to be superior to silica sand and olivine sand for foundry use.

Roasted carbon sand as described in U.S. Pat. No. 5,094,289, is a low cost carbon sand designed primarily for low melting temperature metals, such as aluminum and magnesium. Roasting at 1300°-1400° F. will remove all of the volatile matter which would otherwise be evolved if raw fluid coke were exposed to aluminum poured at 1400° F. Likewise, thermal expansion would be minimal at 1400° F. However, such relatively low temperature roasting does not eliminate porosity in such carbon sand.

Not until the work on the roasted carbon sand described in U.S. Pat. No. 5,094,289 was the full import of porosity in carbon sand realized. Previously, it was believed that raw fluid coke was only moderately porous. It was believed that the evolution of volatile matter, as gases during calcining, created the porosity and that once the porosity occurred, it remained.

Investigations leading to the present invention revealed that porosity exists in raw fluid coke grains and is increased slightly at roasting or calcining temperatures up to about 1900° F. Then, particularly at about 2000° F., the coke apparently shrinks sharply, closing the pores and eliminating the porosity. Increasing the calcining temperature above 2000° F. does not necessarily shrink the coke further. However, in practice, a kiln operated at a considerably higher temperature, such as 2600° F., for example, would likely heat the coke faster and would not allow a significant amount of time at about 2000° F. (soaking time at 2000° F.) to allow full shrinkage to occur. Further, calcining at 2600° F. causes the evolution of volatile gases in a more explosive manner, thereby increasing the formations of pores. It is essential to the present invention that the rate of heating the coke from ambient temperature to about 2000° F. be controlled to avoid the rapid evolution of volatile gases. Typically, a heating rate of about 25° F. to 50° F. per minute has been satisfactory. Shock heating, i.e., instant exposure of room temperature coke to 2000° F. furnace temperature will cause increased porosity.

Previously, carbon sands for foundry use have been produced by calcining fluid coke at various temperatures, none of which centered on a calcining temperature near 2000° F., as disclosed herein.

U.S. Pat. Nos. 2,830,342 and 2,830,913 describe a carbon sand prepared by calcining fluid coke, specifying a "preferred method of calcination is to quickly heat the raw fluid coke up to about 2400° F. to 2800° F. . . . ." Porosity in the resultant product was acknowledged in the patents by the suggestion, ". . . to further pretreat it as by treatment with a solvent or by impregnating it with a suitable material such as water glass or finely divided graphite to decrease its porosity."

Under the protection of those patents, Humble Oil & Refining Company produced carbon sand (1961–1962) by calcining fluid coke at approximately 2500° F. Porosity in that product was acknowledged in their sales literature by suggested remedies for liquid binder absorption.

Carbon sand was produced by Marathon Oil Company (1966–1967) by calcining fluid coke at approximately 2600° F., however, the product was so extremely porous that the project was discontinued. Their unsolved problem with porosity is well documented.

Carbon sand was produced for Carbon Sands, Inc. (1985–1987) by calcining fluid coke at approximately 1850° F. That product retained considerable porosity. (See Bakersfield Coke Table I, hereinafter.) Its applications as a foundry sand were restricted by the higher binder level required.

A carbon sand previously mentioned herein as a product (CAST-RITE 75) of American Colloid Company is being produced by calcining fluid coke at about 2200° F. to about 2300° F. but at a faster rate than disclosed herein. As shown in Table I, that carbon sand is somewhat porous and is inferior with respect to porosity to product prepared in accordance with the present invention, i.e., by calcining at 2000° F.–2100° F. (See Purvis Coke CAST-RITE 75 versus Purvis Coke Calcined at 2070° F. in Table I.)

Since the calcining temperature in rotary kilns used to process fluid coke carbon sands is maintained by the burning of both the volatile hydrocarbon gases evolving from the coke and the carbon coke particles, a distinct advantage in yield and cost favors calcining at the lowest temperature that will produce good product. Therefore, the new technology of the present invention produces a better product and at a lower cost as well.

It is known that calcining at 2600° F. produced carbon sand so extremely porous that cores made of it had almost no strength and hardness, when using normal amounts of liquid binder. Investigation for the present invention revealed that up to about 4.5% by weight water can be absorbed into porous carbon sand while having the visual appearance of dry sand. It follows that in a "green" sand molding mixture containing bentonite and water, an additional 4.5% by weight water would be needed to plasticize the bentonite since 4.5% by weight water is absorbed by the sand grains. Typically, green sand mixtures contain less than 4.5% water, therefore, porous green sand mixtures would necessarily contain twice as much (or more) water. Excessive water creates steam during pouring of molten metal causing casting defects. Therefore, the water content should always be held as low as possible in good foundry practice. Such absorptive porosity could not be tolerated in green sand molding mixtures.

Porous carbon sand will absorb some liquid binders used in cured molds and cores. To achieve adequate strength and hardness, up to twice as much binder may be required. The additional binder would generate additional decomposition gasses during pouring of the metal. Gas evolution from organic binders in cores and molds is a critical factor and a constant problem in foundries. A common casting defect known as a "blow" occurs when volatile gas cannot vent through the sand quickly enough, creating enough gas pressure to bubble through the molten metal, which may solidify before the gas escapes. The entrapped gas remains as an internal cavity in the casting, often times not revealed until the casting is purchased and machined by the customer. Thus, it must be appreciated that a method of preventing porous carbon sand is a breakthrough in carbon sand technology.

It should be recognized that the various commonly-used liquid binder systems vary greatly with respect to the amount and effect of absorption into porous carbon sand. More absorption occurs with thinner liquids, and with the longer time that the carbon sand/liquid binder mixture is held unused and uncured. Some two-part and three-part binder systems employ water-thin catalysts or reactants (such as phosphoric acid, and the like) which are readily absorbed.

In accordance with the following description of the present invention, the term "absorptive porosity" is used to refer to porosity in carbon sand. The following test procedure was used to measure absorptive porosity in accordance with the present invention.

Absorptive Porosity Value (APV) Test Procedure

By this test method the unwanted absorption of water or liquid binders into carbon sand (fluid coke) grains can be quantified. Preferably, several samples for comparison should be tested concurrently to nullify some variables such as ambient room temperature and relative humidity.

TEST PROCEDURE

1. Weigh 500 gram test sample of fluid coke into Pyrex bowl. Dry in conventional oven for 4 hours at 300° F. Allow to cool.
2. Temper dried sample by mixing water into it (5.0 wt.% water based on weight of dried sample). Mix 1 minute in slow speed mixer.
3. Promptly seal wet mixture in a ZIPLOCK freezer bag.
4. Twenty-four hours later, spread moist sample onto a plastic or metal plate (approximately 24"×24") or table top and allow to dry, stirring occasionally.
5. When sample has reached apparent dryness, i.e., free-flowing with no cohesion, return sample to mixer and mix for 1 minute to achieve uniformity. This step requires some judgment on the part of the operator to recognize at what point the sample has lost all of its free water and none of its absorbed water.

6. Promptly, weigh sample into a Pyrex bowl and oven-dry for 4 hours at 300° F. Allow to cool to near room temperature but no longer. Reweigh to determine moisture content by weight difference. Express as wt% water based on weight of air-dried sample. Record as Absorptive Porosity Value (APV).

Typical Absorptive Porosity Values for fluid coke and carbon sands are shown in Table 1.

An inexpensive source for carbon particles useful as a carbon foundry sand is fluid coke that is a by-product of the petroleum refining industry. This petroleum refinery coke, or "raw fluid coke", so named because it is formed in a fluidized bed petroleum refining process, contains about 5% by weight petroleum hydrocarbons that volatilize into gases at the temperature of many molten metals, such as aluminum, copper, brass, bronze, and iron. During the casting of molten metals against raw fluid coke, evolving gases can bubble into the liquid metal and remain as cavities in the solidified casting, causing the casting to be scrapped.

To perform as a superior foundry sand, therefore, fluid coke carbon sand should receive sufficient heat treatment to remove most of the volatile matter and to render it more thermally stable than either silica sand or olivine sand. Prior art carbon sands were devolatilized and pre-shrunk using an expensive, very high temperature heat treatment or calcining process at a temperature of about 2000° F. to 2800°, particularly at temperatures of about 2300° F. to about 2600° F. A general description of the source and process of preparing and heat-treating the Spherical or ovoid grain carbon sand is described in U.S. Pat. Nos. 2,830,342 and 2,830,913 which patents are hereby incorporated by reference. One of the problems found with those materials is that the resulting carbon or coke particles remained porous to water and to some liquid binders in contact with these particles thereby causing substantial surface defects on castings molded with such particles, although the higher temperature calcining process did provide good dimensional stability to the particles.

In accordance with the present invention, it has been found that a spherical or ovoid raw fluid carbon or coke, e.g., petroleum-derived, as described in U.S. Pat. Nos. 2,830,342 and 2,830,913, having a suitable particle size for a foundry molding sand, can be calcined at a controlled rate to a temperature within the range of about 1900° F. to about 2300° F., within a period of preferably more than 30 minutes, and preferably from one to two hours, particularly to about 2000° F. to about 2200° F., e.g., 2100° F., to provide an unexpectedly superior spherical or ovoid carbon foundry sand that is essentially non-porous to liquids, such as water or liquid binders used in foundry sand practice, and produces superior cast or molded metal parts. The carbon foundry sand of the present invention is unexpectedly superior to carbon foundry sands that have been calcined at temperatures of 2300° F. and above, particularly for casting iron, aluminum, brass and bronze.

SUMMARY OF THE INVENTION

In brief, the present invention is directed to a new and improved carbon sand and a method of treating a petroleum fluid carbon or coke, having a spherical or ovoid particle shape and a size suitable for a core or mold surface in the foundry industry, by heating the carbon particles at a temperature in the range of about 1900° F. to about 2300° F., particularly about 2000° F. to about 2100° F., at a heating rate sufficient to render the carbon particles non-porous to liquids, i.e, water and liquid binders, and to volatilize from the carbon particles substantially all of the organic contaminants volatilizable at the treatment temperature, and to improve the thermal stability of the carbon particles, and a method of casting molten metal against the heat treated carbon particles, combined with a suitable binder, to form cast metal parts. The invention also includes the use of the non-porous carbon sand in forming molds and cores by all of the various processes and binder systems in common use, such as green sand and dry sand molding, shell mold processes, binders cured by heat, gases, chemical catalysts and reactants and including the expendable pattern process.

Accordingly, one aspect of the present invention is to provide a new and improved non-porous carbon foundry sand that provides superior performance by rendering the carbon foundry sand non-porous to liquids, such as water and liquid binders.

Another aspect of the present invention is to provide a new and improved non-porous carbon foundry sand produced from spherical or ovoid carbon particles formed in a fluid coking process wherein oil is fractionated into lighter hydrocarbon components and spherical or ovoid coke particles that contain a small percentage (e.g., 0.2% to 10%) of volatile hydrocarbons, by heat-treating the contaminated coke particles at a controlled rate to a temperature in the range of about 1900° F. to about 2300° F., particularly about 2000° F. to about 2100° F., in the absence of contact with additional petroleum hydrocarbons, to render the coke particles non-porous to liquids particularly water and liquid foundry sand binders.

Another aspect of the present invention is to provide a non-porous spherical and/or ovoid mold and/or core sand by heat treating spherical and/or ovoid carbon particles at a controlled rate to a temperature in the range of about 2000° F. to about 2200° F., wherein the carbon particles are formed by coking a petroleum oil to form hydrocarbon gases and non-porous solid spherical or ovoid coke particles that are deposited onto a fluidized bed of other coke particles.

Still another aspect of the present invention is to provide a new and improved, non-porous carbon sand that is prepared by heat-treating carbon particles obtained from a petroleum fractionating process at a controlled rate to a treating temperature in the range of about 1900° F. to about 2300° F., particularly about 2000° F. to about 2100° F., and thereafter coating the particles (spheroidal, ovoidal or ground to a desired particle size distribution) with a thin layer (e.g., 0.1$\mu$ to about 1 mm.) of a resin binder, such as a thermosetting phenolic resin.

The above and other aspects and advantages of the present invention will become apparent from the following detailed description of the preferred embodiments.

DETAILED DESCRIPTION OF THE PREFERRED EMBODIMENTS

The non-porous carbon sand of the present invention, with the exception of the heat-treating step, can be obtained as a by-product from a fluidized bed petroleum fractionating process wherein a petroleum oil, particularly heavy oils, such as a heavy residual oil, is heated to separate it into hydrocarbon vapor fractions and solid carbon or coke particles, including a small percentage of heavy petroleum and sulfur contaminants. The resulting fluid coke particles form a fluidized bed in the fractionating apparatus and contact and heat the incoming oil which further cokes upon the particles. The resulting growth coke particles, known to the trade as "fluid coke," can be screened to provide an average particle size suitable for use as a foundry core making and molding sand, e.g., an American Foundrymen's Society standard Grain Fineness Number within the range of about 40 to about 200 and preferably at least about 50% of the particles to have an GFN of about 50 to about 100.

In accordance with the present invention, it has been found that the coke particles formed in a fluidized bed petroleum fractionating or cracking process are more useful in the foundry industry for forming mold surfaces and mold cores, in both the ferrous and non-ferrous foundries, when heat treated at a controlled rate to a temperature in the range of about 1900° F. to about 2300° F., particularly about 1900° F. to about 2200° F.

To produce product in accordance with the present invention, fluid coke may be calcined by either batch or continuous methods, for example, in a fluidized bed, a vertical elongated chamber or other suitable kiln, or, preferably in a horizontal rotary kiln. Since one aspect of the present invention is the requirement that all the coke particles be heated from ambient temperature to a temperature in the range of about 1900° F. to about 2300° F., preferably about 2000° F. to about 2100° F. at a rate no faster than about 25° F. to 50° F. per minute. Actual residence time in a given kiln must take into account factors such as depth of coke bed, turn over exposure, and the like to accomplish the required heat treatment. Heating to temperatures above about 2100° F.–2300° F. at the specified rate eliminates porosity in the coke particles as they pass through the 2000° F.–2100° F. temperature range, but the higher peak temperature will not appreciably reduce the porosity further and may open additional pores after full shrinkage of the coke particles has occurred.

Any binder ordinarily used to bind silica, olivine, chromite and/or zircon foundry sands can be used with the non-porous carbon sands of the present invention to enable the sand to retain a predetermined or desired shape as a mold or core material. Such binders generally are present in amounts of about 1% to about 15% based on the total dry weight of the foundry sand mixture and may be adjusted to whatever amounts that will produce the desired strength, hardness or other desirable physical properties. Some of the binders which can be used in the non-porous carbon sand of this invention include bentonites, other clays, starches, sugars, cereals, core oils, sodium silicates, thermoplastic and thermosetting resins, vapor-curing binders, chemically-curing binders, heat-curing binders, pitches, resins, cements and various others known to the trade. Further, the non-porous carbon sands of the present invention can be used as the only foundry sand (100%), or the non-porous carbon sand can be used together with silica sand, olivine sand, zircon sand, chromite sand, calcined carbon sand, and the like in various percentages of non-porous carbon sand in an amount of about 5% to about 95% non-porous carbon sand based on the dry weight of the foundry sand used in the composition.

Some additives such as wood flour, cellulose, cereal flours, and iron oxide are sometimes used in common foundry sands for the purpose of overcoming sand expansion defects, particularly those defects occurring on flat casting surfaces, in an amount of about 0.5 to about 5% by weight of dry sand. Such additives can be reduced or eliminated with the foundry sand of the present invention due to the inherently low thermal expansion of carbon sand. The non-porous carbon sand of this invention may be coated with a suitable resin to produce a resin-coated carbon sand particularly useful for the mold and core-making process known to the trade as shell molding. Cements, e.g., portland; natural cements, such as heated, ground limestone; resins and the like in amounts of about 1% to about 10% by weight of the dry sand also can be added to the non-porous carbon foundry sands of the present invention.

Various other additives may be included in the non-porous foundry sand of the present invention, such as various blackings or other carbonaceous materials, such as graphite; pitch; charcoal; bituminous coal, or soft coal, such as seacoal; hard coal; and other cokes which can be used with, or as a partial substitute for the non-porous carbon sand to prevent metal penetration or burn-on; chemical agents, such as resin binders; clay; oils, such as linseed oil, core oils, and the like. These additional additives generally are included in amounts of less than about 1.0% to about 15% by dry weight of the sand.

Greater amounts of certain additives may be used when compounding molds and cores from the fluid coke that is heat treated to eliminate porosity in accordance with the present invention, while the amount of other types of additives normally used can be reduced or eliminated over that normally used with other sands. The percentage by dry weight of additives and binders needed with the foundry sand of this invention may be somewhat greater than that used with silica sands because of the greater volume per weight of fluid coke.

Coal, generally known in the trade as seacoal, or carbonaceous seacoal substitutes, are ordinarily added to silica foundry sand "green" molding sand mixtures to create a reducing atmosphere in the mold during the pouring of molten iron, which minimizes chemical reactions between the iron and the silica sand (silicon dioxide). By replacing silica sand with the non-porous carbon sand of the present invention, such troublesome reactions are precluded and seacoal content can be reduced or eliminated. As a further consequence, smoke and toxic emissions of distillation and partial combustion products evolving into the workplace from poured molds containing coal can be reduced or eliminated.

In accordance with another important embodiment of the present invention, the non-porous carbon sand of the present invention may be ground to a desired particle size distribution, or pulverized to form a carbon flour which can be used as a foundry sand or as an additive to other foundry sands to render such sand mixtures more thermally stable and less permeable to molten metal. In accordance with another embodiment of the present invention, the ground carbon-flour can be incorporated in an aqueous or solvent (e.g., denatured ethanol) slurry (2%–95% carbon flour) and used to coat the surfaces of cores and molds, and subsequently dried, to improve the surface finish of resulting castings.

Experiments have been performed to determine whether a spherical and/or ovoid carbon sand for use in the foundry industry is effective as a mold facing sand when produced by calcining raw fluid coke at various temperatures.

The carbon sands so produced were treated in an iron foundry, or aluminum foundry or in a bronze foundry by combining the carbon sand with a bentonite clay binder, and shaping the sand to form a mold cavity with the carbon sand-binder composition at the metal receiving surface, then molten metal was poured into the mold. The carbon sand heat treated in accordance with the present invention produces castings of iron, aluminum or bronze which are entirely free of penetration, burn-on, or other casting defects attributable to sand. Surface finish imparted by the carbon sand of the present invention is superior to that with silica and olivine sands, and, surprisingly, even better than the surface finish obtained with CAST-RITE® 75 carbon sand, the product presently being marketed to foundries.

Specifically, fluid coke calcined at a temperature within the range of about 1900° F. to about 2300° F., particularly about 2000° F. to about 2100° F., performs exceptionally well as a bentonite-bonded molding sand for iron, aluminum and bronze.

Test Methods and Results

The hereinbefore described test procedure has been used to measure the absorptive porosity of fluid coke products and the term "Absorptive Porosity Value" (APV) has been designated to rate such products. In accordance with the above defined test method, APV is defined as the weight percent of water which a fluid coke product can absorb and still appear to be dry by observation.

The attached Table I, "Effect of Calcining on Properties of Fluid Coke" lists the Apparent Density (lbs./gallon) and the Absorptive Porosity Value (APV) of raw fluid coke and fluid coke treated at various temperatures. It is readily apparent that calcining fluid coke at 2000° F. produced an improved product, i.e., a more non-absorptive carbon sand. The data in Table I also show that raw fluid coke is too absorptive to be marketable as a versatile foundry sand. Table I shows that heat treatment up to about 1850° F. does not eliminate porosity. Also, it shows that Cast-rite 75 (calcined at approximately 2300° F.) is more absorptive than the same raw fluid coke feedstock calcined at 2070° F.

Evidence of grain shrinkage is reflected in the Apparent Density, i.e., pounds per gallon, of the fluid coke product listed in Table I. The highest Apparent Density, (10.0 lbs./gal.), was achieved by calcining Purvis coke at 2070° F., indicating maximum shrinkage had occurred.

As further evidence of the shrinkage phenomenon occurring in fluid coke at about 2000° F., the following screen analyses of Purvis fluid coke before and after calcining at 2070° F. clearly indicate shrinkage:

| | AFS Grain Fineness No. |
|---|---|
| Raw Fluid Coke (half of sample) | 71 |
| Other half of sample after calcining @ 2700° F. | 80 |

These screen analyses, obtained by the AFS Standard Method to determine average grain fineness of foundry sands, indicate that the fluid coke grins shrank to pass a smaller mesh size due to calcining at 2070° F. Slow heating allows the shrinkage to happen at about 2000° F. when heated to the range of about 1900° F. to about 2300° F. at a rate of about 25° F. to 50° F. per minute, but little change occurs as the temperature is raised further.

TABLE I

| Coke Samples | Apparent Density (Lbs./Gal.) | Absorptive Porosity Value |
|---|---|---|
| Raw Fluid Coke (ex Purvis coker) | 7.5 | 3.4 Wt. % |
| Purvis Coke Roasted at 900° F. | 7.7 | 4.2 |
| Purvis Coke Calcined at 2070° F. | 10.0 | 0.14 |
| Purvis Coke Calcined at 2300° F. (Cast-rite 75) | 9.3 | 0.50 |
| Bakersfield Coke Calcined at 1850° F. | 9.0 | 1.2 |
| Raw Fluid Coke (ex Esso/Sarnia) | 7.6 | 3.6 |
| Esso/Sarnia Coke Calcined at 1420° F. | 7.7 | 4.2 |
| Esso/Sarnia Coke Calcined at 1650° F. | 7.9 | 4.3 |
| Tar Sands Fluid Coke (ex Syncrude/Alberta) | 8.2 | 4.5 |
| Tar Sands Fluid Coke Calcined at 2000° F. | 9.4 | 0.24 |

Obviously, the lower the APV the better, since 0% APV indicates zero porosity. Values up to 1.5% are passable, 2.0% would allow use as green systems sand, but not for cores made with some liquid core binders. Product having an APV of 4.0% or more should not be marketed as a carbon sand but could be pulverized and used in mold and core coatings.

EXAMPLE 1

Preparation of Roasted Carbon Sand

One suitable raw fluid coke that can be heat treated in accordance with the present invention is raw fluid coke from the petroleum fluid coke process at the Amarada Hess refinery, Purvis, Miss. (See Purvis Coke, Table I.) However, any coke having a spherical or ovoid grain shape, such as that as produced from a petroleum refinery, and having a particle size suitable for the foundry industry is suitable in accordance with the present invention. Oversize material can be removed by screening the fluid coke through a screen that is sized approximately equal to U.S. Sieve No. 20.

To produce a typical sample of non-porous carbon sand of the present invention, 800 grams of Purvis raw fluid coke was deposited in a 5½" diameter fused silica crucible, loosely covered with fiber insulation to minimize contact with air, then placed in an electrically heated furnace. Power was turned on and rate of heating was controlled so that the fluid coke reached a peak temperature of 2070° F. after 1 hour 15 minutes. The sample was allowed to cool in the crucible for 1 hour, then spread onto a steel plate to cool to room temperature.

What is claimed is:

1. An essentially non-porous carbon foundry sand for use in the foundry industry in forming a molded metal object comprising a plurality of coke particles formed by heating a petroleum oil to separate the oil into hydrocarbon vapors and spherical or ovoid coke particles, and thereafter heat treating the coke particles at a controlled rate in the range of about 25° F. to about 50° F. per minute to a temperature in the range of about 1900° F. to about 2300° F., without substantial heating at a higher temperature, to render the carbon sand non-porous.

2. The carbon foundry sand of claim 1 further including a binder in an amount of about 1% to about 20% by total dry weight of the foundry sand and binder.

3. The carbon foundry sand of claim 1, wherein the sand is heat treated at a temperature of about 2000° F. to about 2100° F.

4. The carbon foundry sand of claim 3, wherein the sand is heat treated at a temperature of about 2050° F.

5. The carbon foundry sand of claim 2, wherein the binder is bentonite clay in an amount of about 8% to about 15% by total dry weight of sand and binder.

6. The carbon foundry sand of claim 1, wherein the coke particles are formed in a fluidized bed oil refining process prior to heat treating, and the particles are separated from the oil being refined prior to the heat treatment, and wherein the heat treatment is carried out for a period of time of at least 45 minutes.

7. The carbon foundry sand of claim 1, wherein the spherical or ovoid particles are ground to a desired particle size distribution.

8. The carbon foundry sand of claim 1, wherein the carbon particles are coated with a resin binder.

9. The carbon foundry sand of claim 1 further including about 5% to about 95% silica sand by total dry weight of carbon sand and silica sand.

10. The carbon foundry sand of claim 1 further including about 5% to about 95% olivine sand by total dry weight of carbon sand and olivine sand.

11. The carbon foundry sand of claim 1 further including about 5% to about 95% chromite sand based on total dry weight of carbon sand and chromite sand.

12. The carbon foundry sand of claim 1 further including about 5% to about 95% zircon sand by total dry weight of carbon sand and zircon sand.

13. A method of manufacturing a cast metal part including forming a foundry sand mixture comprising a non-porous carbon foundry sand and a binder, shaping the foundry sand mixture into a shape having at least one surface with a desired configuration and thereafter pouring molten metal in contact with said shaped surface of the foundry sand to solidify while in contact with said shaped surface of the foundry sand, said non-porous carbon foundry sand comprising a plurality of coke particles formed by heating a petroleum oil to separate the oil into hydrocarbon vapors and spherical or ovoid coke particles, and thereafter heat treating the coke particles at a controlled rate in the range of about 25° F. to about 50° F. per minute to a temperature in the range of about 1900° F. to about 2300° F., without substantial heating at a higher temperature, to volatilize hydrocarbons from the coke particles, to stabilize the thermal expansion/contraction properties of the coke particles and to render the coke particles substantially non-porous.

14. The method of claim 13, wherein the fluid carbon sand is heat treated at a temperature of about 2000° F. to about 2200° F.

15. The method of claim 13, wherein the molten metal is aluminum.

16. The method of claim 13, wherein the molten metal is magnesium.

17. The method of claim 13, wherein the molten metal is brass.

18. The method of claim 13, wherein the molten metal is bronze.

19. The method of claim 13, wherein the molten metal is copper.

20. The method of claim 13, wherein the molten metal is iron.

21. The method of claim 13, wherein the foundry sand mixture further includes an additive selected from the group consisting of coal, seacoal, seacoal substitutes, carbonaceous materials, cellulose, cereal, and fibrous additives in an amount of about 0.5 to about 20% based on the dry weight of the foundry sand.

22. The method of claim 13, wherein the foundry sand mixture includes a binder coating selected from the group consisting of clay, starch, resin, drying oil, sodium silicate, pitch and cement, in an amount of about 0.5 to 20% based on the dry weight of the foundry sand.

23. The method of claim 13, wherein the foundry sand mixture includes a curing agent capable of curing the binder.

24. A method of providing a carbon sand surface onto a mold or core comprising coating the surface of the mold or core with a slurry containing about 5% to about 95% pulverized, non-porous carbon foundry sand and thereafter drying the slurry coating, said carbon foundry sand formed by heating a petroleum oil to separate the oil into hydrocarbon vapors and spherical or ovoid coke particles, and thereafter heat treating the coke particles at a controlled rate to a temperature in the range of about 1900° F. to about 2300° F., without substantial heating at a higher temperature, to volatilize hydrocarbons from the coke particles.

* * * * *

UNITED STATES PATENT AND TRADEMARK OFFICE

CERTIFICATE OF CORRECTION

PATENT NO. : 5,215,143

DATED : JUNE 1, 1993

INVENTOR : EVERETT G. GENTRY

It is certified that error appears in the above-identified patent and that said Letters Patent is hereby corrected as shown below:

Column 9, line 58, after "calcining @" delete "2700° F." and substitute therefor -- 2070° F. --.

Signed and Sealed this

Sixth Day of December, 1994

*Attest:*

Bruce Lehman

BRUCE LEHMAN

*Attesting Officer*

*Commissioner of Patents and Trademarks*